United States Patent [19]

Rohde et al.

[11] Patent Number: 5,019,145

[45] Date of Patent: May 28, 1991

[54] ARGON PURIFICATION

[75] Inventors: Wilhelm Rohde, Munich; Horst Corduan, Puchheim, both of Fed. Rep. of Germany

[73] Assignee: Linde Aktiengesellschaft, Wiesbaden, Fed. Rep. of Germany

[21] Appl. No.: 443,529

[22] Filed: Nov. 30, 1989

[30] Foreign Application Priority Data

Dec. 1, 1988 [DE] Fed. Rep. of Germany ..... 3840506

[51] Int. Cl.[5] ..... F25J 3/04

[52] U.S. Cl. ..... 62/22; 62/24

[58] Field of Search ..... 62/22, 24

[56] References Cited

U.S. PATENT DOCUMENTS

| | | | |
|---|---|---|---|
| 2,861,432 | 11/1958 | Haselden | 62/29 |
| 4,057,407 | 11/1977 | Bigi | 62/22 |
| 4,088,464 | 10/1978 | Bigi | 62/22 |
| 4,296,050 | 10/1981 | Meier | 165/166 |
| 4,838,913 | 6/1989 | Victor et al. | 62/24 |
| 4,871,382 | 10/1989 | Thorogood et al. | 62/24 |

FOREIGN PATENT DOCUMENTS

| | | |
|---|---|---|
| 321163 | 6/1989 | European Pat. Off. . |
| 341854 | 11/1989 | European Pat. Off. . |
| 821951 | 10/1951 | Fed. Rep. of Germany . |
| 1053469 | 9/1959 | Fed. Rep. of Germany . |
| 2521723 | 10/1976 | Fed. Rep. of Germany . |
| 3436897 | 4/1986 | Fed. Rep. of Germany . |

OTHER PUBLICATIONS

Chemical Abstracts, vol. 80, No. 6, Mar. 25, 1974, 61607b.

Ullmans Encyklopadie der technischen Chemie, vol. 2, pp. 534–535.

*Primary Examiner*—Ronald C. Capossela

*Attorney, Agent, or Firm*—Millen, White & Zelano

[57] ABSTRACT

A process and apparatus for air separation by low temperature rectification are described in which argon is obtained exclusively by rectification. A crude argon column (24) is equipped with at least 150 theoretical plates in the form of low pressure drop packing so that, in it, a substantially complete separation of the oxygen is possible, e.g., less than about 10 ppm, preferably less than 1 ppm oxygen.

6 Claims, 1 Drawing Sheet

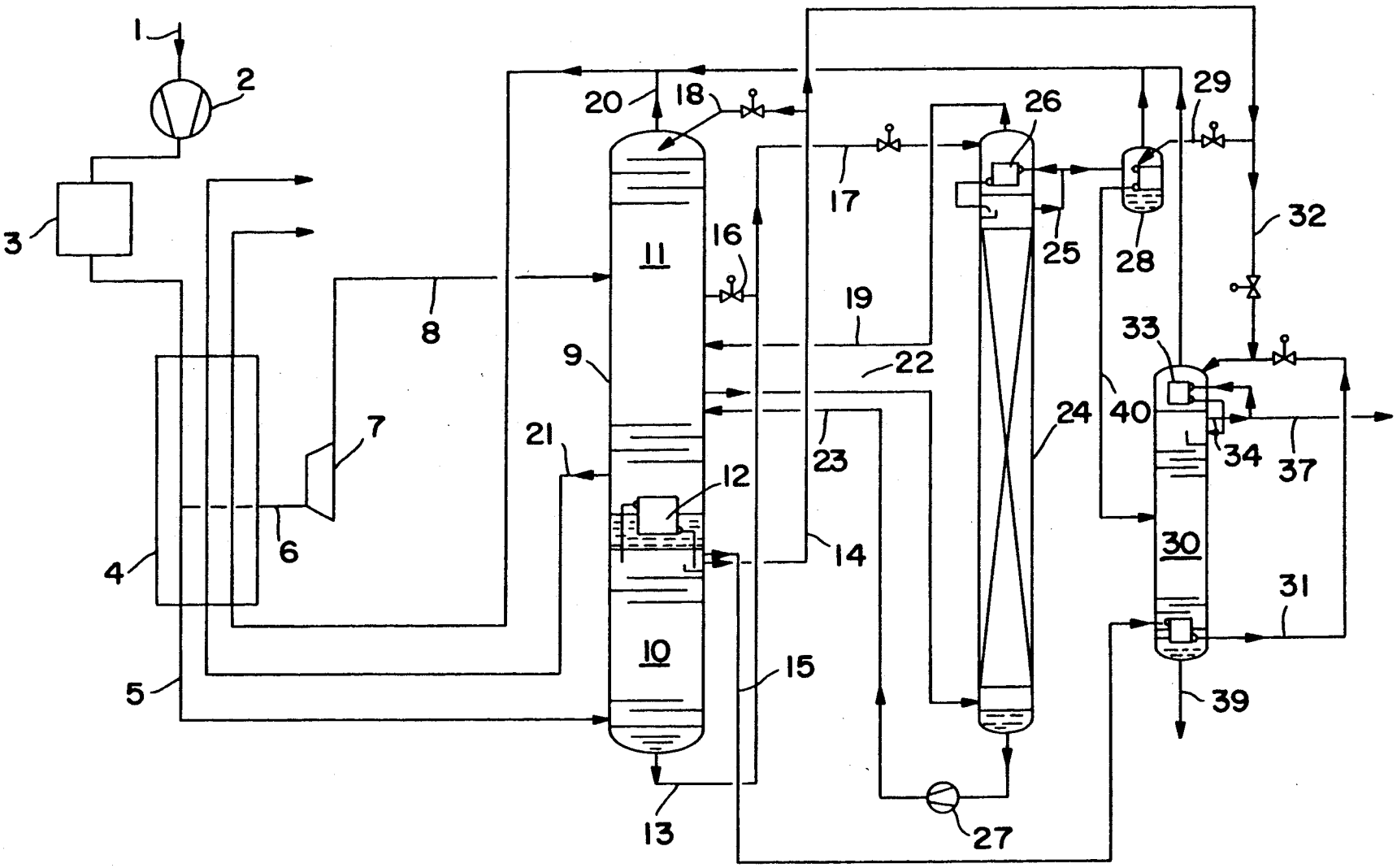
1
2
3
4
5
6
7
8
9
10
11
12
13
14
15
16
17
18
19
20
21
22
23
24
25
26
27
28
29
30
31
32
33
34
37
39
40

ARGON PURIFICATION

BACKGROUND OF THE INVENTION

The invention relates to a process and a device for air separation by low temperature rectification of air, in which air is compressed, prepurified, cooled, fed to a two-stage rectification and separated into an oxygen-rich and a nitrogen-rich fraction and, from the low pressure step of the rectification, another oxygen fraction enriched with argon is removed and separated in a crude argon rectification into crude argon and into a higher boiling residual fraction.

The main products of an air separation, oxygen and nitrogen, can be removed directly from the two-stage rectification. Argon, on the other hand, whose boiling temperature is between the boiling temperatures of oxygen and nitrogen, becomes enriched in the middle section of the low pressure stage of the rectification. At this point, a fraction of mostly oxygen is removed, but in this fraction a large part of the argon contained in the air feedstream is drawn off. This fraction is separated by rectification in a crude argon column into crude argon and a liquid residual fraction. The residual fraction is fed back into the low pressure step.

A process of the type mentioned above is known from DE-OS-34 36 897. There, following a two-stage air rectification in a crude argon column, gaseous crude argon is extracted that contains up to about 95% argon and is contaminated mainly by about 3% oxygen and 2% nitrogen (all percentages refer to the volume). In the previously known processes, during rectification in the crude argon column, which usually contains about 60 exchange plates, the oxygen can be only incompletely removed, since the boiling point of argon and oxygen are extraordinarily close to one another. The difference in the boiling temperatures is, for example, 2.9 K. at a pressure of 1 bar.

If pure argon containing less than 1% impurities is to be extracted, then the remaining oxygen, which exhibits a slightly higher boiling point than argon, must be removed from the crude argon extracted in the known way, before the lower boiling nitrogen is separated in a pure argon column by rectification.

The separation of the oxygen from the crude argon is performed in the known processes in a so-called deoxo device in that the oxygen is burnt with hydrogen mixed in and the water resulting in doing so is separated in a dryer. Such a process has been disclosed, for example, in DE-OS 34 28 968.

Such a deoxo device represents an expensive apparatus and causes, above all, high operating costs due to the not inconsiderable consumption of hydrogen. Especially expensive is the preparation of the hydrogen if it is not readily available from chemical processes that are performed at the site of the air separation unit.

SUMMARY OF THE INVENTION

An object of one aspect of the invention is to provide an improved process and/or apparatus for the purification of argon which will be economically advantageous over prior systems.

Upon further study of the specification and appended claims, further objects and advantages of this invention will become apparent to those skilled in the art.

In order to attain the objects of this invention, the crude argon is rectified in apparatus containing at least 150 theoretical plates.

A separation by rectification of oxygen and argon with an oxygen portion of about 1% and beyond was never seriously considered in the planning of air separation units, since such a method of operation, because of the slight difference of the boiling temperatures of the two materials, appears extraordinarily difficult and expensive. To start with, this prejudice against the sole use of rectification is based on considerations that are briefly explained below.

The head of the rectification column, in which such a separation is to be performed, must be cooled to generate reflux. For this head cooling, only an indirect heat exchange with the bottom fraction from the pressure stage is suitable, as it is usually applied also in crude argon rectification. The bottom fraction here is expanded in a head condenser and liquefied there. By indirect heat exchange, heat from condensing gas in the head of the crude argon column is absorbed. The evaporated bottom fraction is introduced into the low pressure column. But the condition for being able to produce reflux in this way is that the condensation temperature of the gas at the head of the column to be cooled is higher than the evaporation temperature of the evaporating bottom liquid. These temperatures are established by the pressures of the respective fractions. Their values are both tied to the pressure of the low pressure column since, on the one hand, the fraction containing argon to be rectified comes from the low pressure column and, on the other hand, the fraction introduced for cooling is subsequently introduced into the low pressure column. An additional compression of one of the two streams would not be economically viable since, compared to the amount of crude argon obtained, it involves extraordinarily high conversions.

The separation stages of rectification columns in air separation units are almost exclusively achieved by actual plates, e.g., bubble cap plates. But a column for complete separation of oxygen from argon would have to contain such a high number of plates that a great pressure drop would result inside the column. As a result, the pressure at the head of the column would decline so far that the condensation temperature of the head gas would lie below the evaporation temperature of the bottom liquid of the pressure column (30 to 40% of oxygen) at the pressure of the low pressure column (about 1.4 bar). Consequently, generation of reflux liquid would no longer be possible and rectification could not be performed in the column.

Despite these considerations, according to the present invention, a separation of the oxygen exclusively by rectification is surprisingly obtained. This is made possible in that, with the device according to the invention, actual plates are dispensed with and, instead, structured packing or filling materials are used that cause a considerably smaller pressure drop inside the rectification column. Since no experimental values whatsoever were available on the effect of structured packings or filling materials in air rectification, only with the help of experience that was gained in a sizable test unit was it possible to assess the possibilities of achieving a use of packings in this field and especially in the crude argon column. From the tests it turned out that, with a theoretical plate number of at least 150, especially between 150 and 200, preferably about 180, an oxygen content of under about 10 ppm, preferably under 1 ppm is possible with an economical argon yield.

The low pressure drop structured packing or filling materials are preferably of the kind described in German Patent No. 27 22 421 corresponding to U.S. Pat. No. 4,296,050. The pressure drop through the packing or filling in the crude argon column of this invention is lower than 6 millibar per meter (mbar/m), preferably less than 4 mbar/m.

It is especially advantageous to perform this argon rectification right in the crude argon column. In this way, it is true, the crude argon column must have a high number of separation stages which require a comparatively high structural height. But the savings achieved are disproportionately higher than this additional expense, since the oxygen-free crude argon can be fed directly to a pure argon rectification. A deoxo unit to remove residual oxygen does not have to be installed; therein is the main advantage of the invention insofar as the high operating costs of a deoxo device and the associated expenses for process control are completely eliminated.

BRIEF DESCRIPTION OF THE DRAWING

The figure shows, in simplified schematic form, a preferred embodiment of a process for air separation with subsequent argon extraction that is performed according to the invention purely by rectification.

DETAILED DESCRIPTION OF THE DRAWING

Air is drawn in by pipe 1 from compressor 2 and liberated in a purification stage 3 of water vapor and carbon dioxide. The air is next cooled in a heat exchanger 4 countercurrently to product gases and partially introduced by pipe 5 into high pressure column 10 of a two-stage rectification column 9. Another part of the air is branched off in heat exchanger 4 at a medium temperature (pipe 6), substantially isentropically expanded in a turbine 7 and fed by pipe 8 to low pressure column 11.

In a condenser-evaporator 12, gas from the head of the pressure column is condensed against evaporating bottom liquid from the low pressure column and fed as reflux to the pressure column. Gaseous nitrogen (pipe 15) and liquid nitrogen (pipe 14) are removed from the high pressure column. Part of the nitrogen removed as liquid is fed by pipe 18 as reflux liquid into the low pressure column. Bottom liquid from the high pressure column is fed by pipe 13 and partially by pipe 16 to the central section of the low pressure column.

Gaseous nitrogen (pipe 20) and gaseous oxygen (pipe 21) are removed as product streams from the low pressure column and then warmed in heat exchanger 4 to almost the ambient temperature. Another fraction leaves the low pressure column by pipe 22. This fraction containing 87–92%, preferably 90% oxygen, 8–13%, preferably 10% argon and about 0.05% nitrogen is fed to the lower part of a crude argon column 24. Head condenser 26 of crude argon column 24 is cooled by evaporating liquid that is fed by pipe 17 from the bottom of the high pressure column 10. The bottoms liquid in pipe 17 contains 35–40% oxygen and is expanded before introduction into head condenser 26 to about the pressure of the low pressure column. The evaporated portion is introduced by pipe 19 into the low pressure column.

Crude argon column 24, according to the invention, is equipped with structured packings that correspond to a theoretical number of plates of 170–200, preferably about 180, and is operated at the pressure of the low pressure column of 1.2 to 1.6, preferably about 1.3 bar. Instead of packings, filling material with similarly slight pressure loss could also be used. Crude argon that contains not more than about 1 ppm of oxygen is removed as a gas by pipe 25. A part of this crude argon is liquefied in head condenser 26 and fed back into the crude argon column as reflux. The remaining crude argon is condensed in a crude argon liquefier 28 in heat exchange with evaporating nitrogen 29 that comes from the high pressure column. The preferred structured packings are those described in the aforesaid German Patent No. 27 224 24.

Because of the great structural height of the crude argon column made according to the invention (about 30 m), it is possible to exploit in pipe 40 the hydrostatic potential of the crude argon removed at the head of the crude argon column to generate the pressure needed for the fine purification in a pure argon column 30.

In the pure argon column, which can be optionally fabricated like the large rectification column 9 with actual plates, the nitrogen remaining in the crude argon is separated. The bottom of the column is heated by nitrogen gas fed by pipe 15 from the high pressure column. Nitrogen 31 condensed in this way is used together with nitrogen 32 removed as a liquid from the high pressure column for cooling the head of the pure argon column. At the head of the pure argon column, gas is removed by pipe 34 and partially liquefied in head condenser 33 and fed back into pure argon column 30. The remaining part is removed by pipe 37 as residual gas that consists essentially of nitrogen. Liquid pure argon is removed by pipe 39 and still contains overall 1–10 ppm, preferably less than 3 ppm of contaminants, generally predominantly nitrogen.

The entire disclosures of all applications, patents and publications, if any, cited above and below, and of corresponding application Ser. No. P 38 40 506.7 filed Dec. 1, 1988 in the Federal Republic of Germany, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process for air separation by low temperature rectification of air, in which air is compressed, prepurified, cooled, fed to a double rectification column comprising a high pressure column having a top and a bottom, said top being in heat exchange relationship with a low pressure column, and separated into an oxygen-rich and a nitrogen-rich fraction, and from the low pressure column of the rectification, an oxygen fraction enriched with argon is removed and, in a crude argon rectification, is separated into crude argon and a higher boiling residual fraction, the improvement which comprises conducting the crude argon rectification in a column having a head condenser, at least 150 theoretical plates, and provided with low pressure drop structured packings or fillings; and cooling the head condenser with liquid from the bottom of the high pressure column, said crude argon rectification resulting in a sufficient separation of oxygen to eliminate any use of a deoxo unit to remove oxygen from the resultant argon.

2. A process according to claim 1, the resultant crude argon containing at most about 10 ppm oxygen.

3. A process according to claim 1, the resultant crude argon containing at most about 1 ppm oxygen.

4. A process according to claim 1, wherein the crude argon rectification column has about 180 theoretical plates.

5. A process according to claim 1, further comprising separating the crude argon from the crude argon rectification in a pure argon rectification so as to yield a pure argon and a lower boiling residual fraction.

6. Apparatus for performing the process according to claim 1 comprising a double rectification column comprising a high pressure column having a top and bottom and a low pressure column superimposed on said high pressure column, a crude argon column having a head condenser and provided with sufficient structured packings or filled material so as to amount to at least 150 theoretical plates, and a conduit connecting the bottom of the high pressure column with the head condenser of the crude argon column.

* * * * *